US006129298A

United States Patent [19]

Nye

[11] Patent Number: 6,129,298

[45] Date of Patent: Oct. 10, 2000

[54] CONCRETE PULVERIZER WITH ADJUSTABLE RIPPING ELEMENT

[75] Inventor: Mark Nye, Mississauga, Canada

[73] Assignee: National Attachments, Inc., Gorham, Me.

[21] Appl. No.: 09/270,612

[22] Filed: Mar. 17, 1999

[51] Int. Cl.[7] ..... B02C 1/10

[52] U.S. Cl. ..... 241/101.73

[58] Field of Search ..... 241/101.73, 266, 241/264; 30/134

[56] References Cited

U.S. PATENT DOCUMENTS 5,704,560 1/1998 Wimmer ..... 241/101.73

FOREIGN PATENT DOCUMENTS 4322553 1/1995 Germany ..... 241/101.73
2275628 7/1994 United Kingdom ..... 241/101.73

*Primary Examiner*—Mark Rosenbaum

*Attorney, Agent, or Firm*—Dennis R. Haszko; James A. Sheridan

[57] ABSTRACT

A construction vehicle attachment in the form of a pulverizer-ripper unit that includes a pair of jaws confronting and closing on one another and an independent ripper-shank that has a replaceable ripper-tooth. Each jaw includes teeth that serve to engage and fracture concrete slabs. The pulverizer-ripper unit operates under power of any one or a combination of hydraulic, pneumatic, electric, or mechanical powers. The teeth on each jaw are alternated at differing lengths and sizes. The ripper-shank is an elongated finger-like projection pivotably mounted on one of the jaws. The ripper-shank is significantly longer than either jaw and has a range of arcuate motion from a parked-position to a fully-deployed-position with at least two intermediate positions therebetween. The ripper-shank can be locked into such an intermediate position and allows an operator to initially rip up or pry up surfaces, sort and properly orient large chunks, and then subsequently pulverize the chunks with the jaws.

20 Claims, 8 Drawing Sheets

CONCRETE PULVERIZER WITH ADJUSTABLE RIPPING ELEMENT

BACKGROUND OF THE INVENTION

1. Field of Invention

The present invention relates generally to the field of construction equipment. More particularly, the present invention relates to a device for providing added operator-control during demolition and crushing procedures in a construction setting. More particular yet, the present invention involves an improved attachment for construction equipment (e.g., excavators and the like) for enhanced manipulation and crushing of concrete pavement slabs and other similar construction site debris.

2. Description of Prior-art

While the general field of demolition involves problems associated with the destruction and removal of many different types of materials, the more specific field of demolition of concrete-based structures (e.g., sidewalks, road surfaces, bridge decking and abutments, . . . etc.) will be discussed herein. It should be noted that this discussion is limited to the specific field of demolition of concretebased structures for the sole purpose of illustrative clarity and is not meant to limit the intended scope of the invention.

By way of example, highway reconstruction and demolition of structures including reinforced concrete presents a significant problem in the disposal of large pieces of concrete paving or reinforced concrete. Many governmental regulations and practical considerations relating to the operation of landfills prohibit the disposal of concrete slabs and large reinforced concrete structures by burial in landfills. Accordingly, it becomes necessary to dispose of such concrete material in other ways. Crushing of the concrete is one alternative so that the concrete slabs and structures may be reduced to smaller particle sizes. This allows for the reuse of such concrete as fill or as an aggregate base for roadways and other construction sites. To date, there have been several prior-art attempts at reducing concrete structures and slabs into particulate so as to facilitate transport and reuse of such particulate. However, such prior-art attempts have not known adequate devices as described hereinbelow.

In the field of demolition of concrete-based structures such as concrete highway surfaces, the general operation for destruction and removal of such a surface structure typically involves two basic steps. These steps commonly involve first using a backhoe or bulldozer to rip apart the surface layer(s) and then using a crusher-attachment directly coupled to the end of an arm of an excavator or similar construction machine to crush pieces of the torn-up surface layer(s). Such a crusher-attachment is coupled by way of a hinge pin, which is usually pivotally coupled with an excavator bucket or the like. Commonly, a setting cylinder used for pivoting the excavator bucket, which is coupled to the excavator arm at one end, is coupled to one of two jaws of the crusher-attachment, while the other jaw is secured against pivoting about the hinge pin by way of a strut. An example of such a prior-art crusher-attachment is shown in U.S. Pat. No. 4,838,493 issued to LaBounty.

The device of LaBounty is an attachment for the boom structure and hydraulic system of a hydraulic excavator and includes a pair of jaws for crushing concrete slabs. Each jaw has a grid-like jaw structure with multiple teeth and at least one of the jaws is connected to the excavator's hydraulic system. This allows the jaws to apply pressure and fracture concrete structures being gripped and crushed. However, the device of LaBounty and similar devices are limited in their range of manipulation. That is to say, an excavator operator using the device of LaBounty and similar devices is often presented with a pile of debris that is not arranged optimally for the prior-art jaws to easily grasp and crush large chucks of such debris into smaller manageable piles construction debris. This requires repeated attempts by the excavator operator to grasp at the large chunks.

In addition to the time-consuming process mentioned above, the use of a second machine is required to initially tear up the concrete (or asphalt, . . . etc.) structure in order to form the debris pile. More specifically, roadways and sidewalks present a large concrete surface embedded in the earth. Often, such surfaces are reinforced with steel bars known as "re-bar" that present added difficulty in moving and crushing the debris. Still further, such surfaces form large slabs set atop or adjacent one another with an expansion joint of felt or rubber placed between the slabs. Ripping apart the layers with a backhoe or bulldozer is therefore a necessary prerequisite to using crushing devices of the prior-art. With respect to safety and efficiency, the device of LaBounty and similar devices fail to present a viable solution.

Among the prior-art references, several more devices are known and typify the aforementioned problematic excavator attachments. However, none of these below patents touch the disclosure of this invention as described herein.

The device of U.S. Pat. No. 5,062,227 issued to De Gier et al. is an attachment for a hydraulic excavator that includes two opposing jaws. The jaws are movable about a single pivot point. However, this device fails to resolve the issue of manipulating construction debris that is not properly oriented for grasping.

The devices of U.S. Pat. No. 4,908,946 issued to Labounty and U.S. Pat. No. 4,669,187 issued to Pardoe are attachments for a hydraulic excavators that each include two opposing jaws. One jaw includes a blade movable about a pivot point so as to oppose the other stationary jaw. These devices are drawn to cutting or shearing items such as tree stumps and fail to suggest any improvement that would resolve the issue of manipulating any item that is not properly oriented for grasping.

The device of U.S. Pat. No. 4,017,114 issued to LaBounty is an attachment for a hydraulic excavator that includes two opposing grappling-jaws. The grappling-jaws are movable about a single pivot point so as to oppose one another. As well, the grappling-jaws together are rotatable so as to grasp items vertically oriented, horizontally oriented, or oriented somewhere between a vertical and horizontal angle. Although this represents an improvement on the above-mentioned prior-art, such an improvement continues to fail to resolve the problem presented by a large pile of construction debris. This prior-art does not show or suggest any feature that would adequately pick out a single large slab from a mass of construction debris, properly orient such a large slab for grasping, grasp the slab within its jaws, and crush the slab down to a preferred size.

Indeed, none of the prior-art references discussed above adequately provide for the finesse necessary to pick through a pile of construction debris (i.e., concrete slabs/chucks with or without reinforcement bars), extricate a large slab, and pulverize the slab. Contemporary improvements in these prior-art devices have been limited to a cumbersome design that fails provide the excavator operator with any additional ability to pick through and manipulate a pile of construction debris. The prior-art devices do not provide any feature independent of the jaws that would allow the excavator operator to freely move large construction debris pieces so as to re-orient such pieces for better grasping with the jaws. Such ineffective manipulation using the prior-art jaws alone lacks finesse and results in unwanted wear and tear of the jaws. Further, catastrophic misalignment of the jaws, teeth, or shearing blades involved is possible if an operator were to attempt ripping apart a structure with the prior-art crushing device alone. The resulting untimely failure of the given attachment will then require costly and time-consuming repair or replacement.

Accordingly, it is desirable to provide for a new and improved, effective attachment for enhancing demolition for such purposes as, but not limited to, highway reconstruction, bridge repair, or building demolition. What is needed is such an attachment that is easily operated. What is also needed is such an attachment that can be utilized in hydraulic, pneumatic, electric, or mechanical arrangements and combinations. What is further needed is such an attachment that does not require specialized actuation means, but instead can be used in any construction vehicle (e.g., excavators, backhoes, and the like). Still, what is needed is such an attachment that is able to both tear apart a large earth-bound slab or concrete (or the like) into large chucks as well as pulverize such large chunks into manageable pulverized construction debris. Such an attachment should operate in harmony with its crushing features such that enhanced tearing or ripping of earth-bound slabs does not interfere or jeopardize the crushing features. What is also needed is such an attachment that includes a ripper-shank with a ripper-tooth that efficiently operates to allow sorting and indexing of large pieces for trouble-free use of pulverizing jaws. Still further, what is needed is such an attachment that includes a ripper-shank that can be locked in any one of multiple positions and which requires few mechanical parts. Yet still further, what is needed is such an attachment which overcomes at least some of the disadvantages of the prior-art while providing new and useful sorting, indexing, probing, manipulating, prying, and ripping features.

SUMMARY OF THE INVENTION

It is an objective of the present invention to provide a new and improved, effective attachment that is used for both ripping up slabs into large chunks and pulverizing the chunks into smaller pieces. It is another objective of the present invention to provide an attachment that is easily operated by common actuation arrangements found in any construction vehicle (e.g., excavators, backhoes, and the like) including hydraulic, pneumatic, electric, or mechanical arrangements and combinations thereof. Another objective of the present invention is to provide an attachment that a includes a ripper-shank that functions in cooperation with crushing features such that adjacent slabs can be pried apart at expansion joints or punctured and ripped. Still another objective of the present invention is to provide an attachment that delivers increased finesse and dexterity in manipulation of debris while not interfering or jeopardizing the crushing features. It is an objective of the present invention to provide an attachment that includes a ripper-shank having a ripper-tooth that efficiently operates to allow sorting and indexing of large pieces of debris for trouble-free use of the pulverizing jaws. Another objective of the present invention is to provide an attachment having a ripper-shank that can be locked in any one of multiple positions. Such ripper-shank requiring few mechanical parts and including an easily replaceable and highly durable ripper-tooth. Yet another objective of the present invention is to provide an attachment that serves to allow operations including sorting, indexing, probing, manipulating, prying, and ripping.

The present invention is directed to an attachment in the form of a concrete pulverizer with an integrated ripping element (hereinafter "pulverizing-ripper unit") useful for, but not limited to, purposes such as highway reconstruction, bridge repair, or building demolition. Several types of construction vehicles including excavators, backhoes, and the like having hydraulic, pneumatic, electric, or mechanical arrangements (or combinations thereof) are intended beneficiaries of the instant invention. It is desirable that the pulverizer-ripper unit of the current invention be fabricated from durable and hard materials such as those found in the construction equipment trade—e.g., quenched and tempered steel, high-strength-low-alloy steel, or some metal having similar physical qualities. Further, in a chemical environment, stainless-steel may be preferred, whereas in a spark-free environment, aluminum or beryllium may be preferred. For the purpose of illustrative clarity only, the following discussion of the pulverizer-ripper unit will be directed to being made from quenched and tempered steel and used within an excavator for processing concrete slabs. However, it should be understood that this should not be considered to limit the scope of the present invention to excavators and concrete slabs. Rather, any construction vehicle and frangible article may be involved.

The pulverizer-ripper unit is a removable heavy-duty attachment that provides the advantage of being able to disrupt (i.e., rip) and crush concrete and similar structures through the use of an ordinary piece of equipment—e.g., an excavator. The attachment may be mounted on the end of the given excavator's boom structure. More specifically, mounting may occur on the end of a second member known as a dipper stick so as to replace the conventional digging bucket. The attachment is cost-effective and will readily reduce concrete slabs and structures to pulverized form.

The pulverizer-ripper unit includes a pair of jaws confronting and closing on one another. Each jaw includes teeth that serve to engage and fracture concrete slabs. This is accomplished by way of the given excavator's hydraulic system. The teeth on each jaw are alternated at differing lengths and sizes. The teeth progressively engage and penetrate the concrete slab being handled so that the power exerted by the jaws may be progressively applied though the various teeth of the jaws. The pulverizer-ripper unit also includes a ripper-shank that is usually fixed when used but is movable independently of the jaws for adjustment purposes. The ripper-shank is an elongated finger-like projection pivotably mounted on one of the jaws. The ripper-shank is significantly longer than either jaw and has a range of arcuate motion from a parked-position to a fully-deployed-position. Between storage and full-extension, there are at least two intermediate positions into which the ripper-shank can be locked. While the invention detailed herein includes a manually adjustable ripper-shank, it should be readily apparent that any one or a combination of known hydraulic, pneumatic, electric, or mechanical actuation methods may be used to automatically move the ripper-shank. Each actuation method may be used as desired adding the relevant standard parts (e.g., hoses and valves for hydraulic and pneumatic methods or solenoids and wiring harnesses for electric methods) without straying from the overall design of the present invention. Adjusting the ripper-shank position allows the excavator operator to fully utilize the limited positions of the excavator boom.

During use with the ripper-shank of the pulverizer-ripper unit extended to one of intermediate positions or the fully-deployed position, the excavator operator moves the excavator boom towards an earth-bound concrete surface and inserts the ripper-tooth into a slab expansion joint or crack in the surface. The operator then moves the ripper-shank in a manner so as to pry up pieces of the slab. Alternatively, the operator may elect to use the ripper to simply undermine and lift in-place slabs (i.e., slabs that are firmly situated in position), thus breaking these slabs at the expansion joint or any point of a relief fracture (e.g., weak points). Still further, the ripper-tooth may simply be maneuvered to puncture and rip surfaces that are not as hard as concrete such as asphalt or frozen ground. The operator maneuvers the boom so as to pick through the pile with the ripper-shank. In doing so, the operator is able to easily move slabs into positions where suitable alignment with the jaws is possible. When the given surface has been ripped up and sorting is finished, the operator hydraulically angles the pulverizer-ripper unit so that the ripper-shank will not interfere with movement of the jaws. This is accomplished by moving the jaws towards the broken slab chunks. It should be noted that it is not necessary to reposition and store the ripper-shank in order to fracture slab chunks (i.e., pulverize the concrete). Rather, the ripper-shank will typically be positioned a single time for a given day's work. The most versatile positions may be the intermediate positions, but such versatility may change given the particular use. That is to say, full extension of the ripper-shank may be preferred for a full day's work of breaking up an asphalt parking lot, whereas full storage may be preferred for the next day's pulverizing work.

Adjustment of the ripper-shank into any of its fully-deployed, intermediate, or parked-positions is a manual operation requiring the operator to orient the pulverizer-ripper unit so that the mass of the ripper-shank rests solely on its pivot point. The pivot point is a fixed ripper pivot-pin about which the ripper-shank is allowed to rotate. Once the ripper-shank is resting solely on the ripper pivot pin, the operator (or assistant on the ground) will remove the ripper locking-pin. The operator will then continue to move the boom outwardly or inwardly so that the ripper-shank swings into the desired position. That is to say, the ripper-shank will swing to align the ripper locking-pin hole at the desired indexed hole. An index hole exists for each of the fully-deployed, intermediate, and parked-positions. Once the desired index hole is aligned with the ripper locking-pin hole, the operator (or assistant on the ground) will re-insert the ripper locking-pin to again immobilize the ripper-shank. In this manner, manual adjustment of the heavy steel ripper-shank can be quickly and easily accomplished even though the ripper-shank can exceed 600 pounds in weight.

While a locking-pin and a pivot-pin are preferred, it may be possible to utilize any other locking means including the provision of a notched slot and fixed supports in lieu of holes and pins. Such a notched slot would be an arcuate slot along the ripper-shank having notches arranged therealong such that two fixed supports are able to fit into any two notches. The ripper-shank would be able to freely move in an arcuate path upon lifting the ripper-shank so that the supports were moved out of the notches. The ripper-shank would again be secured and unable to freely move in an arcuate path upon re-setting the ripper-shank so that the supports were moved into another set of notches. Such a mechanical method being similar to the arm adjustment method of a conventional lawn-chair, albeit not to scale. It is again noted that it is within the intended scope of the present invention that adjustment may be accomplished in a more automatic manner including hydraulic, pneumatic, electric, or mechanical arrangements and combinations thereof.

Once the ripper-shank is retracted or simply angled away from the slab, the operator maneuvers the boom and opens the jaws towards the positioned slab. The slab is captured by the jaws and pulverized via actuation of the jaw teeth. That is to say, the jaws will be closed onto the opposite surfaces of a concrete slab (or other given frangible article) and the teeth will apply localized pressure at diverse places. This pressure causes the concrete to fracture and break into pieces. The longest teeth of the jaws will first engage and penetrate the concrete slab and will start the breaking of the slab, and then the other teeth spaced along the jaw faces will engage and break the concrete into smaller pieces. This is continued until the concrete slab is pulverized. The operator can continue this rip/sort/capture/pulverize cycle until the entire structure being demolished is completely reduced (i.e., pulverized). The operator may also use the ripper-shank in alternative manners including, but not limited to, ripping through frozen earth or asphalt pavement.

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

DETAILED DESCRIPTION OF THE PREFERRED EMBODIMENTS

The present invention is directed to a construction vehicle attachment in the form of a pulverizer-ripper unit useful for prying, ripping, sorting, properly orienting, and pulverizing frangible structures—e.g., asphalt, concrete slabs, frozen earth, and the like. Due to the nature of use of the present invention, it should be understood that the materials used in the manufacture of each element described below should be a durable and hard material—preferably quenched and tempered steel.

Figure 1:
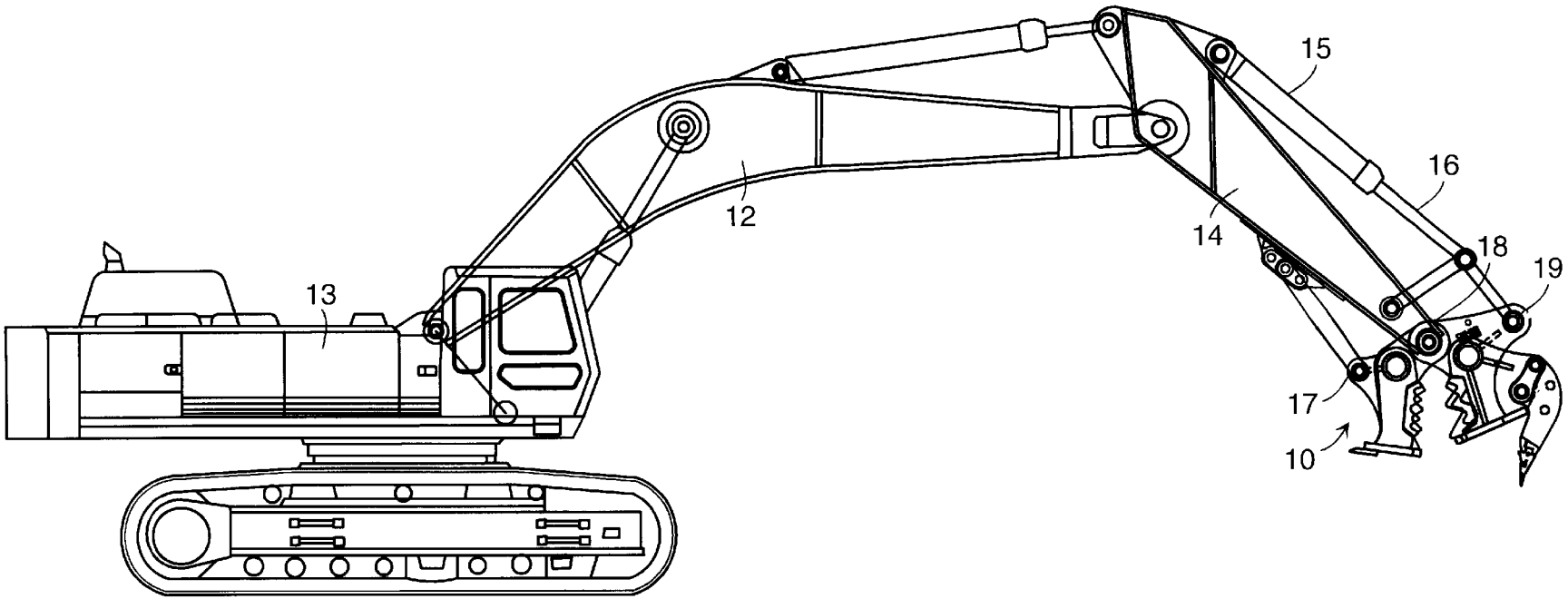
FIG. 1 is a side view of the pulverizer-ripper unit according to a first preferred embodiment of the present invention having a ripper element with three index-holes and shown mounted on the boom structure of an excavator.

Referring now to FIG. 1, there is shown a perspective view of the pulverizer-ripper unit 10 according to a first preferred embodiment of the present invention. The pulverizer-ripper unit 10 is shown mounted on the end on the boom structure 12 of an excavator 13. More specifically, the pulverizer-ripper unit 10 is adapted for mounting on the end of the dipper stick 14 of such an excavator 13. The pulverizer-ripper unit 10 is also adapted for connection to the hydraulic system of the excavator 13. Moreover, the hydraulic system includes a hydraulic cylinder 15 and rod 16 that are mounted on the boom structure 12 and dipper stick 14 and normally used in the excavator 13 for operating a digging bucket (not shown). The pulverizer-ripper unit 10 is pivotably attached at three points 17, 18, and 19 at the end of the boom structure 12 of the excavator 13 in the same manner as would a typical digging bucket (not shown). Operation of the hydraulic cylinder 15 moves the rod 16 in a manner sufficient to actuate the crushing features of the pulverizer-ripper unit 10 as explained in more detail below.

Figure 2:
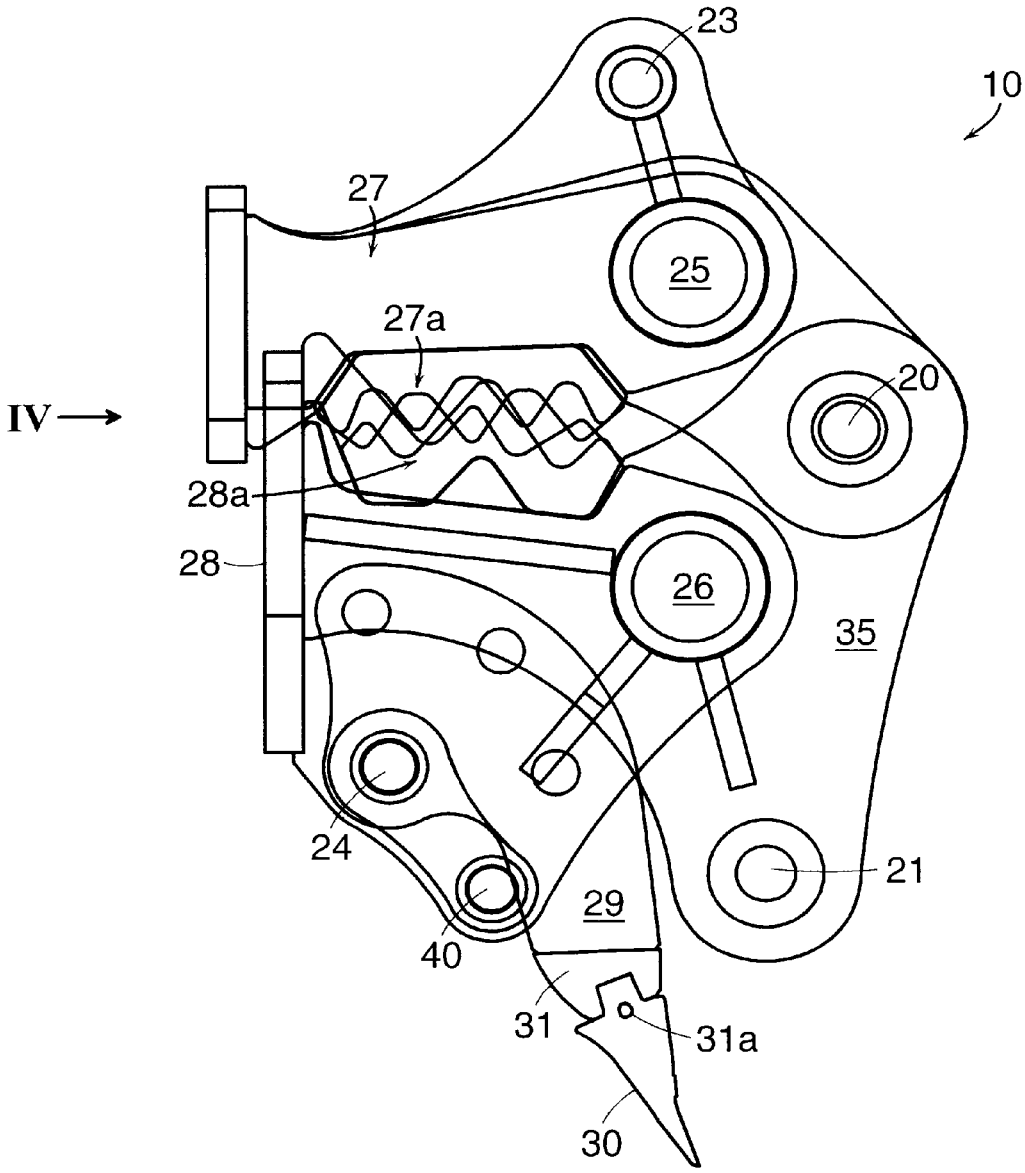
FIG. 2 is a side view of the pulverizer-ripper unit, as shown in FIG. 1, but showing the ripper element in a parked-position.

In FIG. 2, the pulverizer-ripper unit 10 according to the first preferred embodiment is shown in side view such that a ripper-shank 29 can be seen in a parked-position (discussed later). The ripper-shank 29 includes a nose-plate 31 and a ripper-tooth 30. The ripper-shank 29 is formed from a heavy casting of quenched and tempered steel (or suitable other material), while the ripper-tooth 30 is formed from a highly durable material such as, but not limited to, titanium. The nose-plate 31 is preferably formed separately from the ripper-shank 29 and then welded thereupon. This allows the nose-plate 31, prior to welding, to be machined in such a manner so as to allow the ripper-tooth 30 to be removably attached to the nose-plate 31. This provides the desirable feature of being able to easily replace the ripper-tooth 30 when it becomes worn through use. Further, welding two dissimilar metals (e.g., steel and titanium) presents a manufacturing obstacle that is overcome by utilizing such an intermediate piece in the form of the nose-plate 31.

The pulverizer-ripper unit 10 also includes a base-section 35. The base-section 35 has three connection points 20, 21, and 23 that easily allow attachment, respectively, to the three points 17, 18, and 19 at the end of the boom structure 12 of the excavator 13 in the same manner as would a conventional digging bucket (Note FIG. 1). Attachment may be made by any known method of removable attachment, although a heavy-duty cotter-pin or through-bolt arrangement is preferred. The important requirements of any such method of removable attachment are that the method be durable, strong, and detachable. The base-section 35 also may include an optional support ring (not shown) that is used during attachment and detachment of the pulverizer-ripper unit 10. Any known type of hook or chain on a winch or another construction vehicle's boom may be coupled to such a support ring so as to facilitate such attachment and detachment.

With continued reference to FIG. 2, the base-section 35 further includes an upper jaw pivot 25 and a lower jaw pivot 26. An upper jaw section 27 is movably connected to the base-section 35 via the upper jaw pivot 25. Similarly, the lower jaw section 28 is movably connected to the base-section 35 via the lower jaw pivot 26.

Each jaw section 27 and 28, respectively, includes multiple projections in the form of upper teeth 27*a* and lower teeth 28*a* with a working gap therebetween. The teeth 27*a* and 28*a* are alternated at differing lengths and sizes. The upper teeth 27*a* oppose the lower teeth 28*a* and progressively engage and penetrate any frangible structure (e.g., concrete slabs and the like) placed in the working gap. The frangible structure is then pulverized via the hydraulic force of hydraulic cylinder 15 and rod 16 (see FIG. 1) progressively applied though the various teeth by each jaw section 27 and 28.

Figure 3:
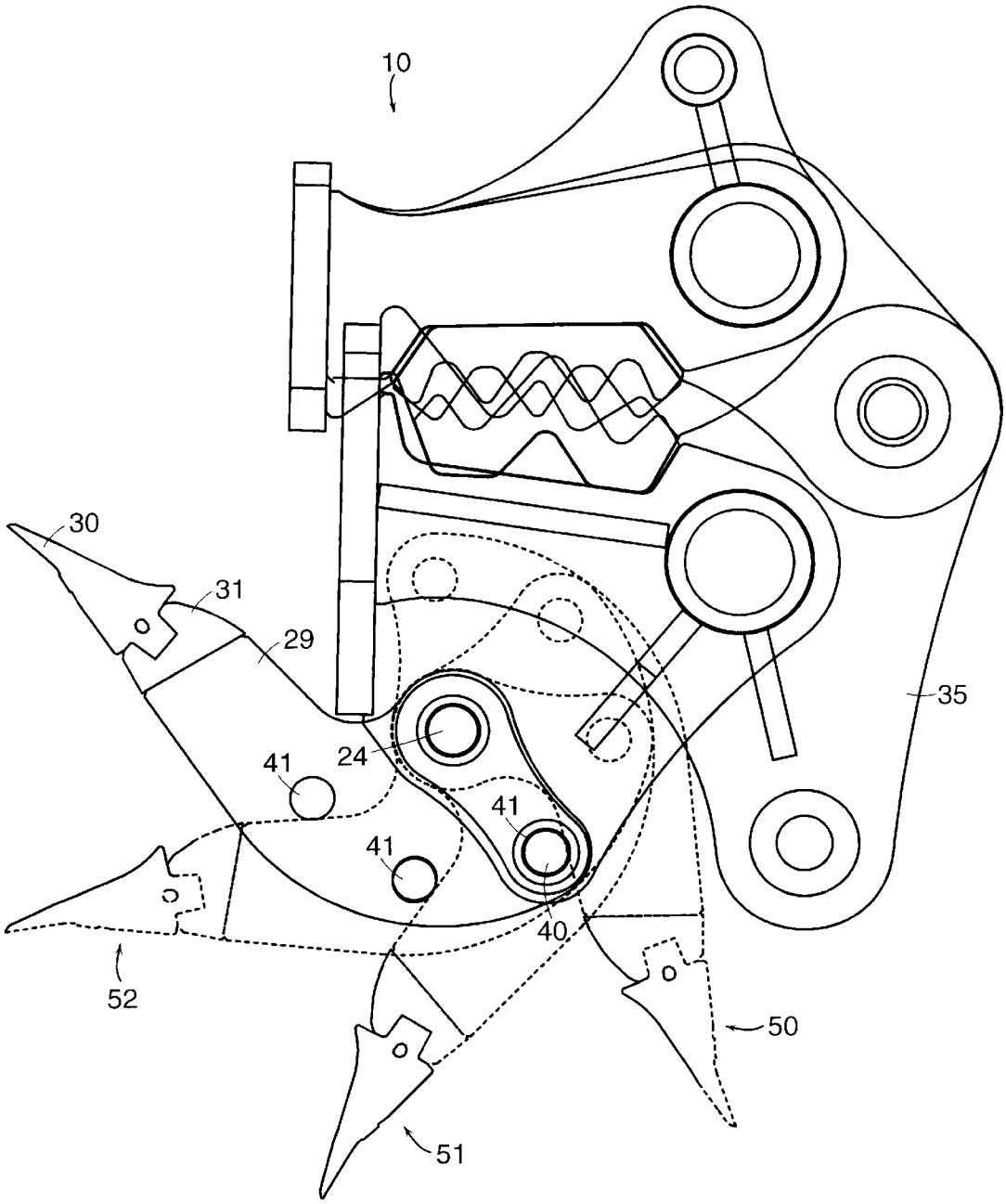
FIG. 3 is a side view of the pulverizer-ripper unit, as shown in FIG. 2, but showing the multiple positions of the ripper element.

With reference to FIG. 3, the base-section 35 also includes a pivot-pin 24 about which the ripper-shank 29 is pivotably mounted. While ripper-shank 29 is shown in the fully-deployed-position, all three other positions are shown in FIG. 3 and indicated in silhouette by dotted lines. Specifically, the parked-position, the first intermediate-position, and the second intermediate-position are shown, respectively by indications 50, 51,and 52. While the pivot-pin 24 allows the ripper-shank 29 to rotate thereabout in an arcuate path, a locking-pin 40 is used to selectively prevent such rotation of the ripper-shank 29. That is to say, it is preferred that the ripper-shank 29 be adjustably immobilized in each position (i.e., the parked-position, the fully-deployed-position, and each intermediate-position) by means of the locking-pin 40. The locking-pin 40 may be mechanical (e.g., bolts, cotter-pins, . . . etc.) or may be related to electromechanics, hydraulics, pneumatics, . . . etc. For illustrative clarity, the preferred locking-pin 40 is shown for a manual type of adjustment. As well, the manual type may be preferred for heavy use applications of the pulverizer-ripper unit 10 of the present invention due to the inherent reliability presented by the reduction of necessary parts. However, it is contemplated that any type of adjustment method may be utilized to effectuate indexed movement of the ripper-shank 29 among the desired positions. Such methods may include hydraulic, pneumatic, electric, or mechanical arrangements and combinations thereof. Accordingly, the use of conventional mechanisms (e.g., solenoids, air-actuated-pistons, hydraulic cylinders and rods, and the like) necessary for such arrangements are also considered to be well within the scope of the present invention.

In operation, the ripper-shank 29 moves in the arcuate path about the pivot-pin 24 between the parked-position and the fully-deployed-position. It should be noted that within the arcuate path of travel, there may be more than two intermediate-positions although two intermediate-positions is preferred so as to enhance the overall usefulness of the present invention. As the preferred material for the pulverizer-ripper unit 10 is steel, the weight of the ripper-shank 29 is high. Thus manual adjustment of the ripper-shank 29 into any of its positions requires an excavator operator to orient the pulverizer-ripper unit 10 so that the mass of the ripper-shank 29 rests solely on the pivot-pin 24. This releases any pressure on the locking-pin 40 so that the locking-pin 40 can easily be removed. Once the locking-pin 40 is removed, the excavator operator will then continue to move the boom structure 12 outwardly or inwardly. This allows the ripper-shank 29 to freely swing into the desired position where the through-hole in the base-section 35 for the locking-pin 40 is aligned with the desired index-hole 41.

An index-hole 41 exists for each of the fully-deployed, intermediate, and parked-positions. Once the desired index-hole 41 is aligned with the through-hole for the locking-pin 40, the excavator operator (or assistant on the ground) will re-insert the locking-pin 40 into the desired index-hole 41 that is now aligned with the through-hole in the base-section 35 for the locking-pin 40. Thus, the locking-pin 40 again immobilizes the ripper-shank 29 against any arcuate movement. In this manner, manual adjustment of the heavy steel ripper-shank 29 can be quickly and easily accomplished even though the ripper element (i.e., ripper-shank 29, nose-plate 31, and ripper-tooth 30) can present a combined weight of more than 600 pounds. It is again noted that it is within the intended scope of the present invention that ripper element adjustment may be accomplished in a more automated manner by including any known hydraulic, pneumatic, electric, or mechanical arrangements and combinations thereof. Thus, in a more automated arrangement, the ripper-shank 29 would be actuated from the remote location of the excavator operator's cab.

Figure 4:
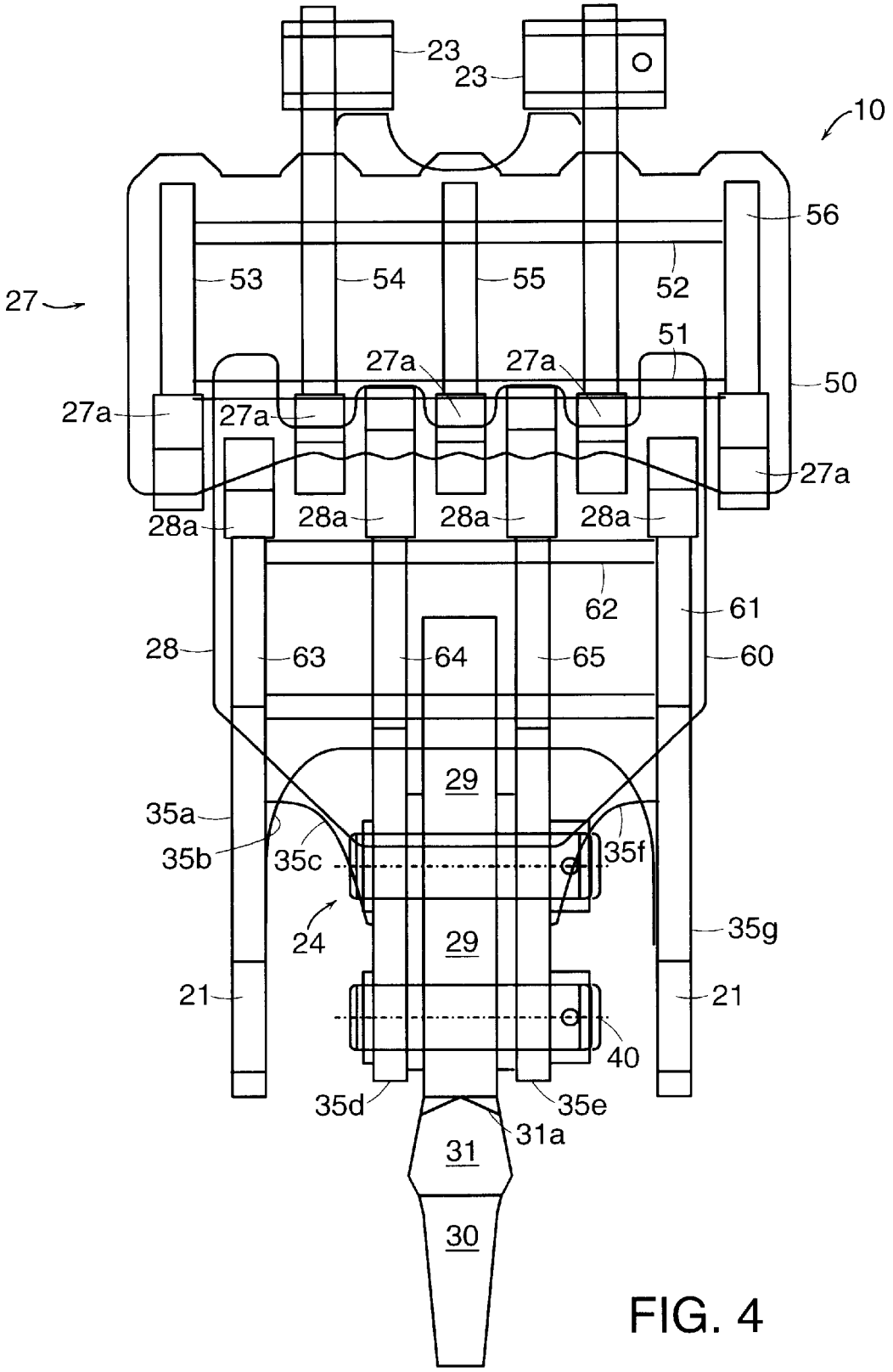
FIG. 4 is a cross-sectional top view of the pulverizer-ripper unit, as shown in FIG. 2, but showing the inner structural features.

Turning now to FIG. 4, the inner structure of the pulverizer-ripper unit 10 is shown by way of a cross-sectional view taken from the direction IV indicated in FIG. 2. A network of steel plating that are preferably welded together forms the pulverizer-ripper unit 10. It should be understood that, where possible, such plating may be formed integrally by a single casting. However, current welding technologies are considered to provide sufficiently strong welds. Plates 35*a*–35*g* in a manner consistent with standard metal-working procedures form the base-section 35 (seen more clearly in FIG. 2). More specifically, it can be seen that the pivot-pin 24 and locking-pin 40 are designed to pass through the plates 35*d* and 35*e* of the base-section 35 as described above with respect to adjustment operation of the ripper-shank 29. From FIG. 4, it can also be seen that the nose-plate 31 forms a weld 31*a* where attached to the ripper-shank 29. Similarly, two networks of plates 50–56 and 60–65 form each of the upper jaw section 27 and lower jaw section 28, respectively. Further, a set of upper teeth 27*a* and a set of lower teeth 28*a* are formed as shown, respectively, on each of the two networks of plates 50–56 and 60–65.

While a preferred plate configuration is shown, it should be noted that any other configuration of the network of plates is possible so long as the primary consideration of reducing the amount of steel (or other material) required is accomplished without jeopardizing structural integrity of the resulting pulverizer-ripper unit 10. In this way, the overall weight of the pulverizer-ripper unit 10 may be kept to a manageable and preferred range for demolition purposes. More specifically, other configurations that result in a reduction of weight of the pulverizer-ripper unit 10 may be desirable for applications on construction equipment smaller than a hydraulic excavator. Such modifications in plate configuration in order to reduce the overall weight of the invention are considered to be within the intended scope of the present invention.

Figure 8:
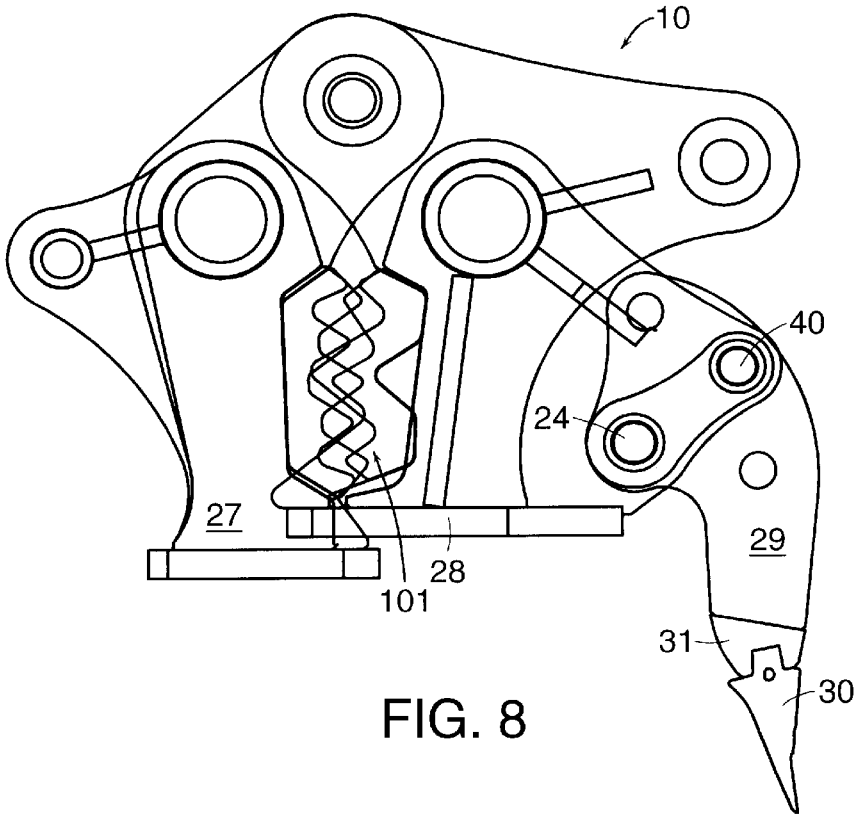
FIG. 8 is a side view of the pulverizer-ripper unit as shown in FIGS. 5–7, but now shown in a second intermediate-position.

FIGS. 5 through 9 detail the range of arcuate movement of the pulverizer-ripper unit 10 according to the first preferred embodiment of the present invention. It should be understood that any mechanical adjustment method may be utilized such that arcuate or pivoting movement is provided, including, but not limited to, configurations using notched slots and fixed supports. However, FIGS. 5 through 8 serve to better show the arcuate motion utilizing the preferred pin and hole arrangement of adjustment among the parked-position (FIG. 5), the fully-deployed-position (FIG. 6), the first intermediate-position (FIG. 7), and the second intermediate-position (FIG. 8). The working-gap 101 formed between the jaw sections 27 and 28 will be discussed using FIGS. 5 through 8 to better teach the relationship between the working-gap 101 and the ripper-tooth 30. It can be seen that the distance between the working-gap 101 and the ripper-tooth 30 varies from greatest in the parked-position (FIG. 5) to smallest in the fully-deployed-position (FIG. 6) with variations therebetween in the first intermediate-position (FIG. 7) and the second intermediate-position (FIG. 8).

Figure 5:
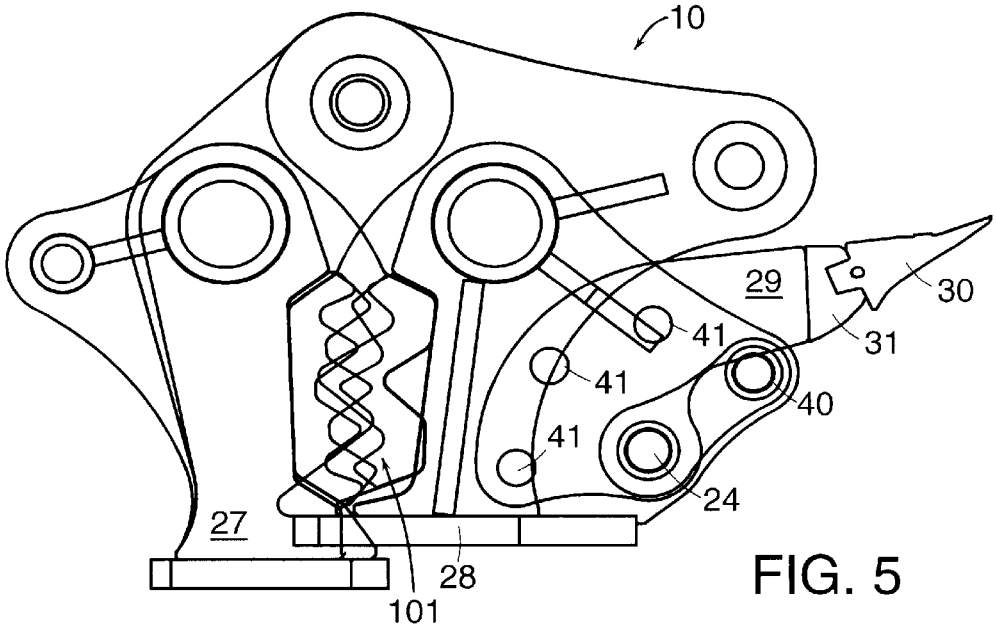
FIG. 5 is a side view of the pulverizer-ripper unit identical to FIG. 2 but oriented so as to illustrate the variable ripper element positions in relation to FIGS. 6 through 8.
Figure 6:
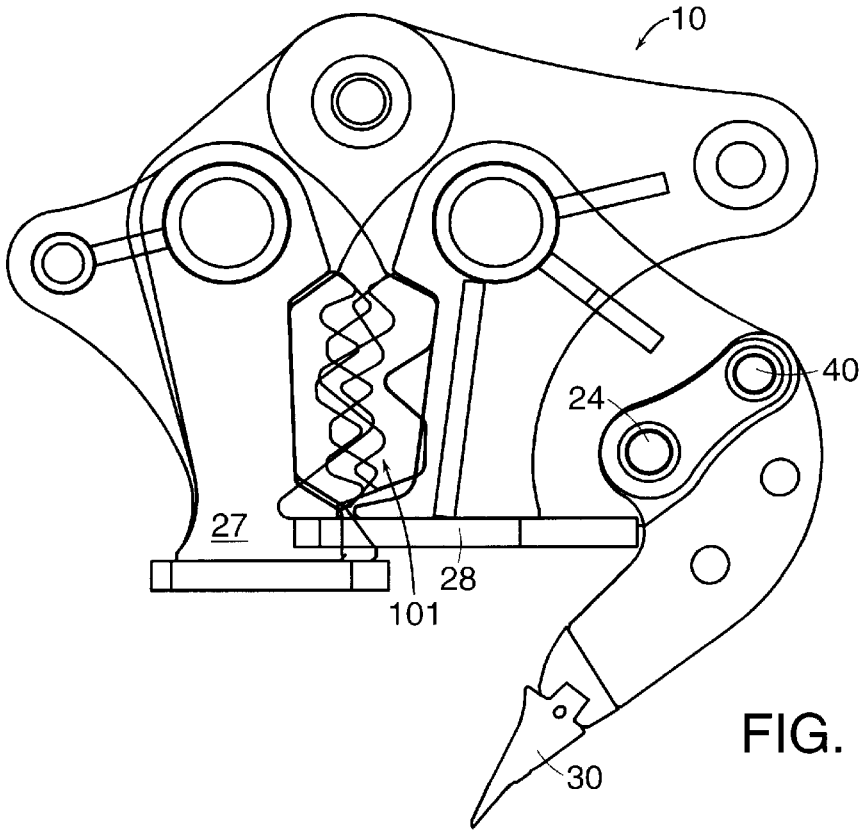
FIG. 6 is a side view of the pulverizer-ripper unit as shown in FIG. 5, but now shown in a fully-deployed-position.
Figure 7:
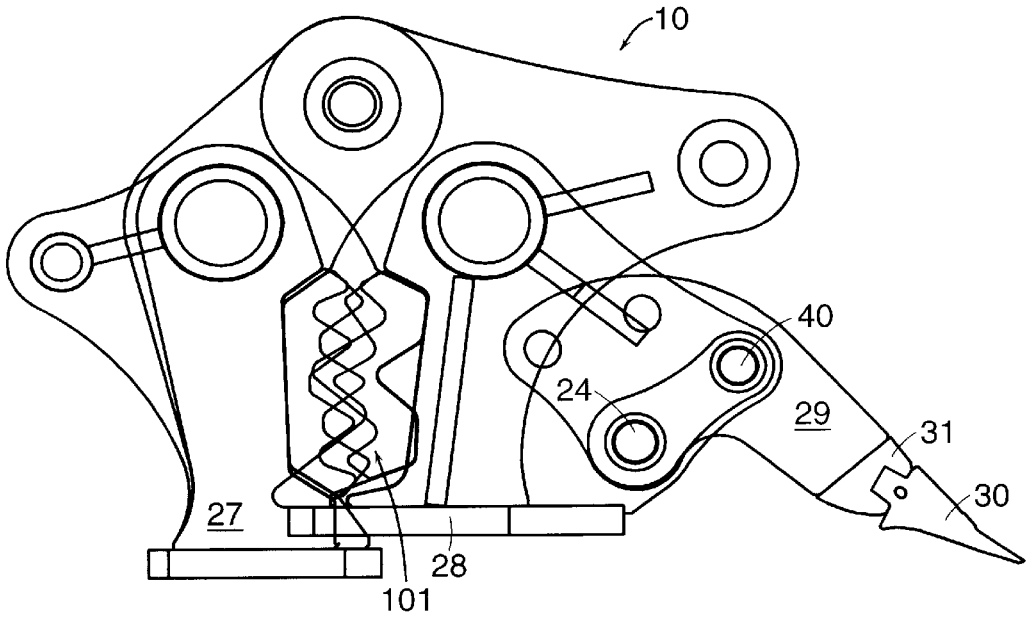
FIG. 7 is a side view of the pulverizer-ripper unit as shown in FIGS. 5–6, but now shown in a first intermediate-position.

The large distance between the working-gap 101 and the ripper-tooth 30 in the parked-position of FIG. 5 allows an excavator operator to utilize the crushing features of the jaw sections 27 and 28 without interference by the ripper-tooth 30. Similarly, the small distance between the working-gap 101 and the ripper-tooth 30 in the fully-deployed-position of FIG. 6 allows an excavator operator to utilize the ripping (and prying, sorting . . . etc.) features of the ripper-tooth 30 without interference by the jaw sections 27 and 28. Each intermediate-position of FIGS. 7 and 8 add flexibility to an excavator operator's use of the instant invention so that adjustment of the ripper-shank 29 by way of locking-pin 40 and pivot-pin 24 is not required to fully utilize the dual ripping and pulverizing functions in a more simultaneous manner.

Figure 9:
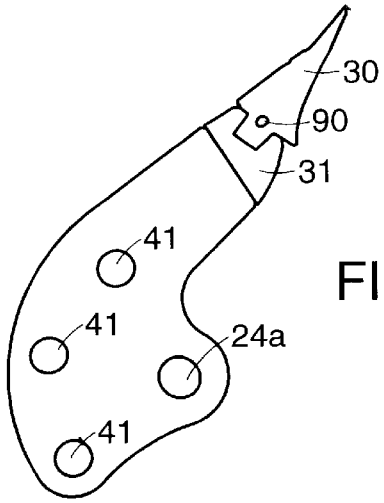
FIG. 9 is a side view of the ripper element with three index-holes according to the first preferred embodiment.

In FIG. 9, it is shown that the ripper-shank 30 is formed with three index-holes 41 along with the pivot-hole 24*a* to thus provide for the number of possible positions of ripper-shank 29. As shown, nose-plate 31 and ripper-tooth 30 are included where the ripper-tooth 30 is removably attached to the nose-plate 31 via an attachment means 90 that may be any kind of bolt, screw, or similar known means for secure yet removable attachment.

Figure 13:
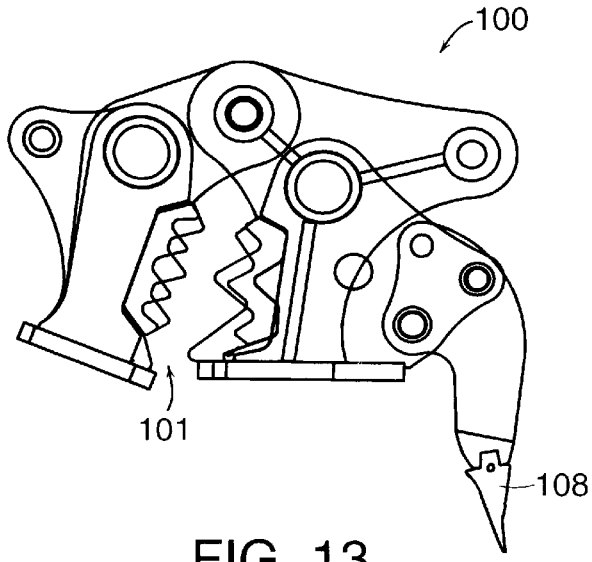
FIG. 13 is a side view of the pulverizer-ripper unit according to the second preferred embodiment as shown in FIGS. 10–12, but now shown in a second intermediate-position.

FIGS. 10 through 14 detail a pulverizer-ripper unit 100 according to a second embodiment of the present invention. The same underlying inventive pulverizer-ripper concept as shown in the first embodiment 10 remains unchanged. As with respect to the first preferred embodiment above, a working-gap gap 101 formed between jaw sections 105 and 106 will be discussed using FIGS. 10 through 13 to better show the relationship between the working-gap 101 and the ripper-tooth 108. The distance between the working-gap 101 and the ripper-tooth 108 varies from greatest in the parked-position (FIG. 10) to smallest in the fully-deployed-position (FIG. 11) with variations therebetween in the first intermediate-position (FIG. 12) and the second intermediate-position (FIG. 13). As discussed above, this allows an excavator operator to utilize the crushing features of the jaw sections 105 and 106 without interference by the ripper-tooth 108 and vice-versa.

Figure 10:
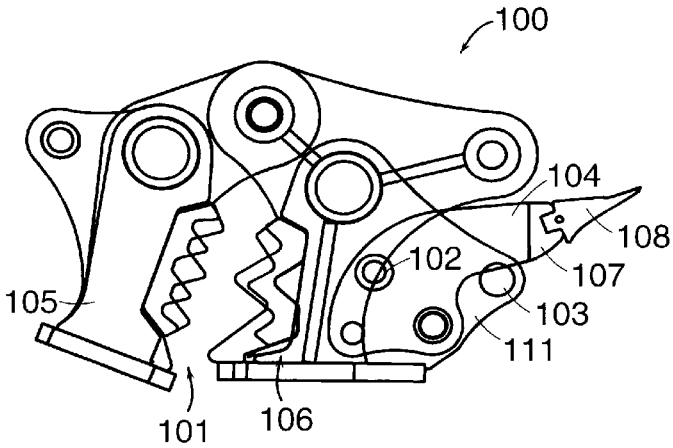
FIG. 10 is a side view of the pulverizer-ripper unit according to a second preferred embodiment of the present invention having a ripper element with two index-holes and shown in a parked-position.
Figure 11:
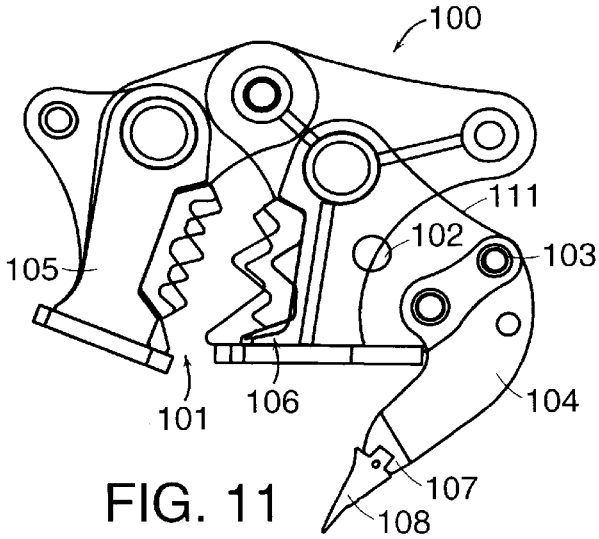
FIG. 11 is a side view of the pulverizer-ripper unit according to the second preferred embodiment as shown in FIG. 10, but now shown in a fully-deployed-position.
Figure 12:
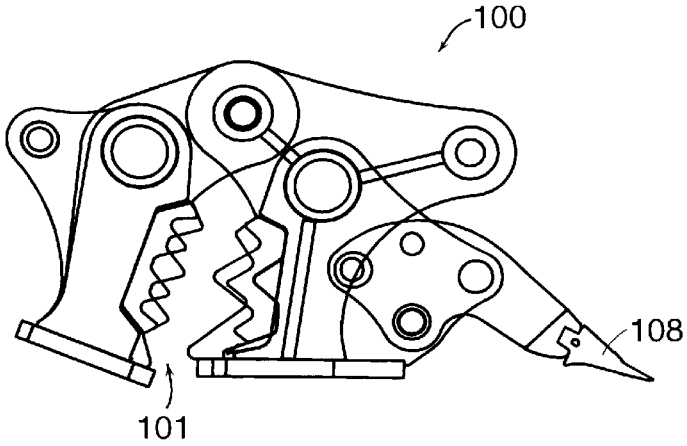
FIG. 12 is a side view of the pulverizer-ripper unit according to the second preferred embodiment as shown in FIGS. 10–11, but now shown in a first intermediate-position.
Figure 14:
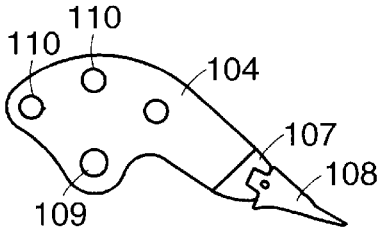
FIG. 14 is a side view of the ripper element with two index-holes according to the second preferred embodiment as shown in FIGS. 10–13.

The specific differences between the first preferred embodiment 10 and the second preferred embodiment 100 are discussed with reference to FIGS. 10, 11, and 14. In FIG. 14, it is shown that the ripper-shank 104 can be formed with only two index-holes 110 along with the pivot-hole 109 without altering the number of possible positions of ripper-shank 104. As in the first embodiment 10, a nose-plate 107 and a ripper-tooth 108 are included. In the second preferred embodiment 100, the base-section 111 includes an additional through-hole 102. By way of comparison, this is in addition to through-hole 103, which corresponds to the through-hole in which locking-pin 40 is situated within in FIGS. 2 and 4. Overall, this second preferred design provides for a smaller ripper-shank 104 and thus a more compact pulverizer-ripper unit 100. This may be important in applications where attachment size is desired to be held to a minimum such as, but not limited to, cramped construction sites like underground garages or mining operations.

It should be understood that the preferred embodiments mentioned here are merely illustrative of the present invention. Numerous variations in design and use of the present invention may be contemplated in view of the following claims without straying from the intended scope and field of the invention herein disclosed.

I claim:

1. A pulverizer-ripper unit for use as an attachment to a construction mechanism, said pulverizer-ripper unit comprising:

a base-section pivotably attachable to a construction mechanism, said base-section including an upper jaw pivot, a lower jaw pivot, and a support;

an upper jaw element pivotably mounted on said base-section via said upper jaw pivot;

a lower jaw element pivotably mounted on said base-section via said lower jaw pivot; and a ripper-shank movably mounted on said base-section via said support.

2. The pulverizer-ripper unit as claimed in claim 1, wherein said upper jaw element includes a plurality of upper teeth, said lower jaw element includes a plurality of lower teeth, and said upper teeth and said lower teeth are arranged such that said upper teeth oppose said lower teeth with a working gap located therebetween.

3. The pulverizer-ripper unit as claimed in claim 2, wherein said ripper-shank includes a nose-plate affixed to an end of said ripper-shank and a ripper-tooth removably attached to said nose-plate.

4. The pulverizer-ripper unit as claimed in claim 3, further including a means for locking said ripper-shank into one of a plurality of indexed positions, said indexed positions including a parked-position, a fully-deployed-position, and at least one intermediate-position between said parked-position and said fully-deployed-position such that, absent said locking means, said ripper-shank is movable so as to travel an arcuate path between said parked-position and said fully-deployed-position, wherein said parked-position places said ripper-tooth distant from said working gap and said fully-deployed-position places said ripper-tooth nearer to said working gap.

5. The pulverizer-ripper unit as claimed in claim 4, wherein said support is a pivot-pin located on said base-section and said locking means is an index-pin.

6. A pulverizer-ripper unit for use as an attachment to a construction mechanism, said pulverizer-ripper unit comprising:

a base-section pivotably attachable to a construction mechanism, said base-section including an upper jaw pivot, a lower jaw pivot, and a pivot-pin;

an upper jaw element pivotably mounted on said base-section via said upper jaw pivot;

a lower jaw element pivotably mounted on said base-section via said lower jaw pivot; and a ripper-shank pivotably mounted on said base-section via said pivot-pin.

7. The pulverizer-ripper unit as claimed in claim 6, wherein said upper jaw element includes a plurality of upper teeth, said lower jaw element includes a plurality of lower teeth, and said upper teeth and said lower teeth are arranged such that said upper teeth oppose said lower teeth with a working gap located therebetween.

8. The pulverizer-ripper unit as claimed in claim 7, wherein said ripper-shank includes a nose-plate affixed to an end of said ripper-shank and a ripper-tooth removably attached to said nose-plate.

9. The pulverizer-ripper unit as claimed in claim 8, further including a locking-pin for locking said ripper-shank into one of a plurality of indexed positions, said indexed positions including a parked-position, a fully-deployed-position, and at least one intermediate-position between said parked-position and said fully-deployed-position such that, absent said locking-pin, said ripper-shank is pivotable about said pivot-pin so as to travel an arcuate path between said parked-position and said fully-deployed-position, wherein said parked-position places said ripper-tooth distant from said working gap and said fully-deployed-position places said ripper-tooth nearer to said working gap.

10. The pulverizer-ripper unit as claimed in claim 9, wherein said ripper-shank is able to be locked into any one of said parked-position, said fully-deployed-position, and said at least one intermediate-position via an adjustment means.

11. The pulverizer-ripper unit as claimed in claim 10, wherein said adjustment means is chosen from the group consisting of a mechanical means, a pneumatic means, a hydraulic means, and an electric means.

12. The pulverizer-ripper unit as claimed in claim 10, wherein said adjustment means is a manual means while said upper jaw element and said lower jaw element function hydraulically.

13. A pulverizer-ripper unit for use as an attachment to an excavator, said pulverizer-ripper unit comprising:

a base-section pivotably attachable between a hydraulic piston of an excavator and a dipper stick of said excavator, said base-section including an upper jaw pivot, a lower jaw pivot, and a pivot-pin;

an upper jaw element pivotably mounted on said base-section via said upper jaw pivot;

a lower jaw element pivotably mounted on said base-section via said lower jaw pivot; and a ripper-shank pivotably mounted on said base-section via said pivot-pin;

wherein said pulverizer-ripper unit is formed from a durable material.

14. The pulverizer-ripper unit as claimed in claim 13, wherein said upper jaw element includes a plurality of upper teeth, said lower jaw element includes a plurality of lower teeth, and said upper teeth and said lower teeth are arranged such that said upper teeth oppose said lower teeth with a working gap located therebetween whereby a frangible structure placed within said gap is pulverized upon actuation of said hydraulic piston of said excavator.

15. The pulverizer-ripper unit as claimed in claim 14, further including a locking-pin, wherein said ripper-shank is pivotable about said pivot-pin so as to travel an arcuate path between a parked-position and a fully-deployed-position, said parked-position placing said ripper-tooth distant from said working gap and said fully-deployed-position placing said ripper-tooth nearer to said working gap, and said locking-pin is removable such that said ripper-shank is able to be immobilized from arcuate movement in one any of said parked-position, said fully-deployed-position, and at least one intermediate-position along said arcuate path between said parked-position and said fully-deployed-position.

16. The pulverizer-ripper unit as claimed in claim 15, wherein said ripper-shank includes a nose-plate affixed to an end of said ripper-shank and a ripper-tooth removably attached to said nose-plate, said ripper-tooth being formed of a highly-durable, metallic material different from said durable material.

17. The pulverizer-ripper unit as claimed in claim 16, wherein said ripper-shank is positioned among said parked-position, said at least one intermediate-position, and said fully-deployed-position by a mechanical means for adjustment.

18. The pulverizer-ripper unit as claimed in claim 16, wherein said ripper-shank is positioned among said parked-position, said at least one intermediate-position, and said fully-deployed-position by means of a pneumatic means for adjustment.

19. The pulverizer-ripper unit as claimed in claim 16, wherein said ripper-shank is positioned among said parked-position, said at least one intermediate-position, and said fully-deployed-position by means of a hydraulic means for adjustment.

20. The pulverizer-ripper unit as claimed in claim 16, wherein said ripper-shank is positioned among said parked-position, said at least one intermediate-position, and said fully-deployed-position by means of an electrical means for adjustment.

* * * * *